US011245239B2

(12) United States Patent
Katz et al.

(10) Patent No.: US 11,245,239 B2
(45) Date of Patent: Feb. 8, 2022

(54) METHOD FOR PRODUCING A SOCKET CONTACT

(71) Applicant: Amphenol-Tuchel Electronics Gmbh, Heilbronn (DE)

(72) Inventors: Wolfgang Katz, Leingarten (DE); Joachim Stolz, Besigheim (DE); Martin Wacker, Öhringen (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 119 days.

(21) Appl. No.: 16/621,599

(22) PCT Filed: Jun. 14, 2018

(86) PCT No.: PCT/EP2018/065773
§ 371 (c)(1),
(2) Date: Dec. 11, 2019

(87) PCT Pub. No.: WO2018/229178
PCT Pub. Date: Dec. 20, 2018

(65) Prior Publication Data

US 2020/0106231 A1 Apr. 2, 2020

(30) Foreign Application Priority Data

Jun. 14, 2017 (DE) ..... 10 2017 113 115.9

(51) Int. Cl.

| | |
|---|---|
| ***H01R 43/16*** | (2006.01) |
| ***B21D 35/00*** | (2006.01) |
| *H01R 13/10* | (2006.01) |
| *H01R 13/187* | (2006.01) |

(52) U.S. Cl.
CPC ..... *H01R 43/16* (2013.01); *B21D 35/003* (2013.01); *H01R 13/10* (2013.01); *H01R 13/187* (2013.01); *Y10T 29/49204* (2015.01)

(58) Field of Classification Search
CPC ..... H01R 43/16; H01R 13/10; H01R 13/187; B21D 35/003; Y10T 29/49174; Y10T 29/49204
USPC ..... 29/857, 874
See application file for complete search history.

(56) References Cited

U.S. PATENT DOCUMENTS

| | | | | |
|---|---|---|---|---|
| 4,534,603 A * | 8/1985 | Brown | H01R 13/187 439/82 |
| 6,656,002 B2 * | 12/2003 | Zhao | H01R 11/22 439/787 |
| 6,837,756 B2 * | 1/2005 | Swearingen | H01R 4/4881 439/843 |
| 2005/0164566 A1 | 3/2005 | Zhao et al. | |

(Continued)

FOREIGN PATENT DOCUMENTS

| | | |
|---|---|---|
| CN | 1511361 A | 7/2004 |
| CN | 104525762 A | 4/2015 |
| DE | 198 33 675 A1 | 2/2000 |

(Continued)

*Primary Examiner* — Donghai D Nguyen
(74) *Attorney, Agent, or Firm* — Blank Rome LLP

(57) ABSTRACT

The invention relates to a method for producing a socket contact consisting of a sleeve and a contact cage which are formed from a first and a second metal strip. In said method, at least one step for forming the sleeve and a step for forming the contact cage are carried out in a parallel shaping process.

11 Claims, 4 Drawing Sheets

(56) References Cited

U.S. PATENT DOCUMENTS

2017/0054262 A1 2/2017 Byrne

FOREIGN PATENT DOCUMENTS

| | | | |
|---|---|---|---|
| DE | 20 2016 100 095 | U1 | 1/2016 |
| DE | 20 2016 106 666 | U1 | 12/2016 |
| WO | WO 2007/084085 | | 7/2007 |
| WO | WO 2012/088968 | A1 | 7/2012 |

* cited by examiner

METHOD FOR PRODUCING A SOCKET CONTACT

RELATED APPLICATIONS

This application is a national stage application of International Application No. PCT/EP2018/065773, filed Jun. 14, 2018, which is related to and claims priority to German Patent Application No. 10 2017 113.115.9, filed Jun. 14, 2017, the entire disclosures of which are hereby incorporated by reference.

The invention relates to a method for producing a socket contact, wherein the socket contact consists of a sleeve and a contact cage.

Various embodiments of socket contacts are already known from the prior art. These are frequently of a multipart design, wherein the individual parts are produced separately from one another and only connected to one another in a further assembly process which is independent from the respective production processes. A spatial separation of the production and the assembly results in additional steps for preparing the assembly, in which steps the individual components first must be aligned with respect to one another before they can be connected. There is also the fact that, as a result of the separate production of the components, during the assembly a sufficient quantity of components of the various types must be supplied such that they are available in the appropriate number during the assembly. However, a stock of individual components must therefore be constantly maintained and tracked. As an alternative, the components must each be counted, so that they are available in the respectively required quantity. Additional supply processes and stock-keeping, however, are expensive and time-consuming. Moreover, if a production process for a component of the socket contact is quicker than another production process, the various production processes must either be laboriously timed to coincide with one another or delayed, which leads to expensive and inefficient production. Furthermore, various production methods, machine types or feed rates can also lead to different rates of production.

The invention is therefore based on the object of overcoming the abovementioned disadvantages and providing an efficient method for producing socket contacts, in which method the individual socket contact components do not have to be kept in stock and the socket contact components can be connected to one another quickly and easily. This method is intended to be less expensive and quicker than the known conventional methods.

This object is achieved by the combination of features as claimed in patent claim 1.

For this purpose, according to the invention, a method for producing a socket contact, in particular a high-current socket contact, is proposed. The socket contact consists of a sleeve and a contact cage. In the method, the sleeve is produced or formed from a first metal strip and the contact cage is produced or formed from a second metal strip. In the method, at least one step for forming the sleeve and one step for forming the contact cage are performed in a parallel shaping and forming process.

The first and the second metal strip each have a longitudinal direction. The method comprises at least one step of feeding the first metal strip into a first punching device and feeding the second metal strip into a second punching device.

The method further comprises a step of perforating and die-stamping the first metal strip by a punching tool of the first punching device. The perforation of the first metal strip is carried out in each case after a first predetermined length, such that a portion of the metal strip in the longitudinal direction is delimited by a perforation in each case with respect to the next, directly adjacent portion of the metal strip. The perforation may be formed by a plurality of apertures or openings which are arranged beside one another or are adjacent to one another or by at least one connecting web between in each case two sleeve blanks of the metal strip. The first metal strip is formed by the die-stamping, which may take place at the same time as the perforating or independently thereof, to give a sleeve blank having connection portions. The sleeve blank is connected by the perforation or the at least one connecting web to a subsequent or preceding sleeve blank. As a result, the first metal strip is formed by the perforating and die-stamping to give a plurality of sleeve blanks connected at the perforation. By means of the die-stamping, the sleeve blank forms latching, counter-latching and retaining elements, in which, for example, protrusions, recesses and latching lugs are provided, in order to fix the sleeve produced from the sleeve blank to the contact cage. As an alternative, the sleeve may be fixed by latching, counter-latching and retaining elements to other components as well, in order to fix the socket contact as a result. Integrally with or subsequent to the die-stamping, these latching, counter-latching and retaining elements can also be bent. The die-stamping may be made up of a punching-out, a punching-in or an embossing operation, or mixed forms thereof. The connection portions of the sleeve blank are formed in each case at the edge regions of the sleeve blank in the longitudinal direction of the first metal strip and mutually correspond. The connection portions serve to connect the sleeve blank to itself and/or align it with respect to itself during the forming to give the sleeve.

Advantageously, the method additionally comprises at least the step of perforating and die-stamping the second metal strip by a punching tool of the second punching device. The perforation of the second metal strip is carried out after in each case according to a second predetermined length, wherein the second metal strip is formed by the die-stamping to give a plurality of contact cage blanks connected to one another by the perforation. This step of perforating and die-stamping the second metal strip is performed in particular at the same time as or parallel to the step of perforating and die-stamping the first metal strip, such that for each sleeve blank, a contact cage blank is formed. The contact cage blank is formed with a grating structure and connection portions. The connection portions of the contact cage blank are formed in each case at the edge regions of the contact cage blank in the longitudinal direction of the second metal strip and mutually correspond, such that the connection portions can be connected to one another or brought into engagement with one another during the forming of the contact cage blank to give the contact cage. The grating structure substantially forms the contact region to a contact element of a plug, which in later use is plugged into the socket contact. The grating structure is formed in particular by a plurality of webs running parallel to one another, such that a first edge region is connected by the plurality of webs to a second edge region and the first and second edge regions, which are opposite one another on the contact cage blank in the width direction of the second strip, each connect the connection portions to one another. Here, the grating structure is formed by a plurality of contact lamellae. The contact cage blank is connected to a subsequent contact cage blank by the perforation, which is formed by a plurality of apertures or openings that are contiguous with one another or adjacent to one another, or by at least one connecting web, such that the second metal strip is formed to give a plurality of contact cage blanks connected at the perforation. The respective edge regions of the contact cage blank can be aligned with one another and/or connected to one another in the longitudinal direction of the second metal strip by the connection portions.

Within the context of the invention, it can be said both that, during the perforating and die-stamping, a respective metal strip is formed into a sleeve blank or contact cage blank or into a plurality of sleeve blanks or contact cage blanks which are connected to one another and that, after the perforating and die-stamping, the respective metal strip consists of or is formed by a plurality of sleeve blanks or contact cage blanks which are connected to one another.

The first and second predetermined lengths are related to one another and are each substantially the inner circumference respectively of the tubular sleeve or the tubular contact cage. The second predetermined length determines the inner diameter of the contact cage and is dependent on the outer diameter of that contact element of the plug which is to be received. The first predetermined length determines the inner diameter of the sleeve and is formed such that the sleeve can receive the contact cage. The first predetermined length thus corresponds substantially to the second predetermined length plus $2*\pi*x$ and plus a compensation value y, where x is the thickness of the second metal strip and the compensation value y determines the play between the sleeve and the contact cage. The unequal first and second predetermined lengths result in different feed rates for the first and second metal strip during the perforating and die-stamping. Since the sleeve blanks are longer than the contact cage blanks, the first metal strip must be fed at a greater rate than the second metal strip for producing the contact cage blanks.

The method additionally comprises the following steps:

feeding the first metal strip, consisting of the plurality of sleeve blanks, to a first separating and forming device and feeding the second metal strip, consisting of a plurality of contact cage blanks, to a second separating and forming device, separating and forming the first metal strip, consisting of a plurality of sleeve blanks, in the first separating and forming device, wherein in each case a sleeve blank is separated from the first metal strip at the perforation and formed by rolling or bending to give a sleeve, as a result of which a hollow-cylindrical shape, which is open to both sides in the width direction of the first metal strip and/or tubular, is obtained, separating and forming the second metal strip, consisting of a plurality of contact cage blanks, in the second separating and forming device, wherein in each case a contact cage blank is separated from the second metal strip at the perforation and formed by rolling or bending to give a contact cage, as a result of which a hollow-cylindrical shape, which is open to both sides in the width direction of the second metal strip and/or tubular, is obtained.

Separating and/or forming the metal strips can take place parallel to and separately from or integrally with one another. The width direction here is in each case orthogonal to the respective longitudinal direction of the metal strip. The sleeve blanks and contact cage blanks are each bent or rolled about an axis which is orthogonal to the longitudinal direction of the respective metal strip.

Additionally, before the separating, after the forming or between separating and forming of the sleeve blanks or of the contact cage blanks, a further step may be performed, in which the sleeve blanks or the contact cage blanks are formed and, for example, numbers are stamped or latching, counter-latching and/or retaining elements are formed.

To assemble the sleeve blanks and the contact cage blanks with one another, the method further comprises at least the following steps:

feeding the sleeve and the contact cage to an assembly device, assembling the sleeve and the contact cage in the assembly device to give the socket contact, wherein the contact cage is pushed into the sleeve and fixed to the sleeve.

By virtue of one sleeve blank being formed for each contact cage blank, no supply shortfalls can occur during the assembly. There is also the fact that the sleeve blanks and the contact cage blanks are formed immediately before the assembly to give the sleeves and contact cages and no additional alignment is necessary in order to align them for the assembly, since the sleeves and contact cages are kept in the orientation required for the assembly.

Advantageously, the first and the second punching device and the first and the second separating and forming device are connected to one another at least in terms of control technology or are formed integrally with one another, such that the respective method steps are parallelized. In this way, unequal rates in the production of the sleeves and contact cages cannot occur.

In a further advantageous method variant, the first and the second punching device are also formed integrally with one another. The first and second punching devices may have, for example, a common control system or be driven by a common drive.

In an advantageous refinement, the first and the second punching tool may also be formed in one piece with one another. Separating and forming tools for the separating and forming may also be formed in each case in one piece or integrally with one another.

In a refinement of the method, the grating structure of the second metal strip is formed by punching out cutouts or openings running parallel to one another. The cutouts are arranged orthogonally with respect to the longitudinal direction of the second metal strip or at an angle to the longitudinal direction of the second metal strip. The webs or contact lamellae are formed between each of the cutouts, as a result of which a lamellar structure is obtained. As an alternative, the webs may also have a curved profile instead of a straight profile.

Advantageously, before the separating and forming of the second metal strip, the method may comprise an additional step of forming the second metal strip, in which the second metal strip is compressed in its width, orthogonal to the longitudinal direction, such that a central region running along the metal strip protrudes convexly out from the second metal strip. This forms, a contact and clamping region in which the contact cage makes contact with the contact element of the plug when the plug is plugged into the socket contact.

In an advantageous refinement of the method, during the die-stamping of the first and the second metal strip, a connection portion is formed in each case on two edge portions which are opposite in the longitudinal direction of the respective metal strip, which connection portions engage into one another or bear against one another during the forming of the respective metal strip.

A further advantageous method variant provides that, during the die-stamping of the first and/or the second metal strip, mutually corresponding latching, counter-latching and/or retaining elements are punched into the first and second metal strips. The sleeve and the contact cage can be fixed to one another by the latching, counter-latching and/or retaining elements during assembly. Additionally, the sleeve and/or the contact cage can be connected to the rest of the socket, into which the socket contact is inserted. The latching elements may be formed by latching lugs and counter-latching elements and the retaining elements may be formed by protrusions and supporting surfaces.

To form the contact and clamping region on the contact lamellae of the contact cage, an advantageous method variant provides that, during the forming of the contact cage blank to give the contact cage, the contact cage is twisted such that a region that is central in a width direction of the second metal strip, from which the contact cage is formed, and runs in an encircling manner in a circumferential direction is constricted. The constriction causes a central region of the contact cage to protrude convexly in the circumferential direction and bulge inward. The torsion may be assisted by shaping pressure elements, such that the torsion follows a predetermined shape.

During the assembly of the sleeve with the contact cage, the latching elements are latched to a respective counter-latching element or arranged such that the respective supporting surfaces or latching elements bear against a retaining element in order to fix the contact cage in the sleeve. This can also be implemented by an additional forming operation, such as for example bending a lug through a breakout.

Additionally, during the forming or the assembly or thereafter, the connection portions of the sleeve and/or of the contact cage may be connected to one another in a material-bonded fashion, for example by soldering.

The features disclosed above can be combined as desired, provided that this is technically possible and they are not mutually exclusive.

Other advantageous refinements of the invention are characterized in the dependent claims or illustrated in more detail below, together with the description of the preferred embodiment of the invention, on the basis of the figures, in which:

The figures are by way of example and schematic. Identical reference designations in the figures indicate identical functional and/or structural features.

Figure 1:
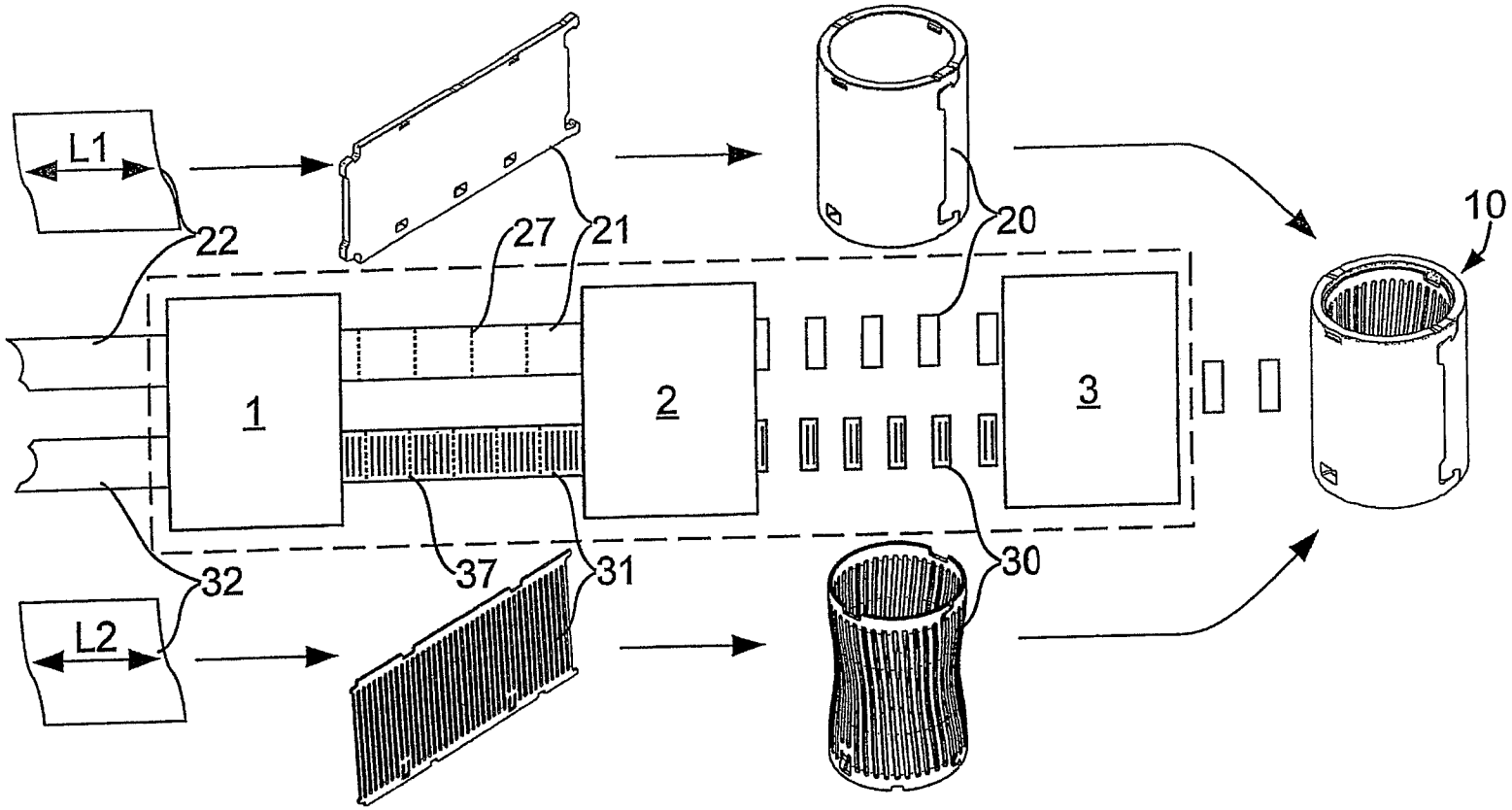
FIG. 1 shows a schematic representation of a method according to the invention.

FIG. 1 shows a method according to the invention. Here, the first and second metal strips 22, 32, each having a longitudinal direction L1, L2, are fed to the method in each case by a roller (not illustrated). The metal strips 22, 32 run parallel to one another into the punching device 1, which has two punching tools formed integrally with one another and with which the metal strips 22, 32 are each formed by perforating and die-stamping. Here, the first metal strip 22 is formed into a plurality of sleeve blanks 21 connected by the perforation 27 and the second metal strip 32 is formed into a plurality of contact cage blanks connected by the perforation 37. Sleeve blanks and contact cage blanks 21, 31 run, in a manner connected in each case by the perforations 27, 37 to give a strip, parallel to one another into the separating and forming device 2, in which the individual sleeve blanks and contact cage blanks 21, 31 are separated at the respective perforation 27, 37 and formed. During the forming in the separating and forming device 2, the sleeve blanks or contact cage blanks 21, 31 are each rolled, such that tubular sleeves 20 or contact cages 30 are respectively formed. During the forming, the connection portions 25', 25", 35', 35" formed on the sleeve blanks 21 and on the contact cage blanks 31 are each latched to or brought into engagement with the corresponding connection portions, such that the sleeves 20 keep their shape and cannot spring apart from one another and the contact cages 30 are aligned with respect to themselves at their respective connection portions 35', 35". Additionally, the contact cages 30 are twisted after the rolling by virtue of the fact that the regions which are opposite in the width direction of the metal strip are fixed and twisted towards one another, as a result of which a constriction forms in the encircling region 36. The sleeves 20 and the contact cages 30 are transported from the separating and forming device 2 into the assembly device 3, wherein for each sleeve 20, a contact cage 30 is formed and transported to the assembly device 3. In the assembly device 3, one contact cage 30 in each case is pushed into one sleeve 20, or one sleeve 20 is pushed onto one contact cage 30. Here, the latching elements 33, 34 are latched to the respective counter-latching elements 24 or are brought to bear against the retaining elements 23, as a result of which the contact cage 30 is fixed in the sleeve 20 and the socket contact 10 has been formed. The dashed line in FIG. 1 schematically shows that the individual method steps by the punching device 1, the separating and forming device 2 and the assembly device 3 are arranged in one installation or in a manner spatially directly following one another.

Figure 2:
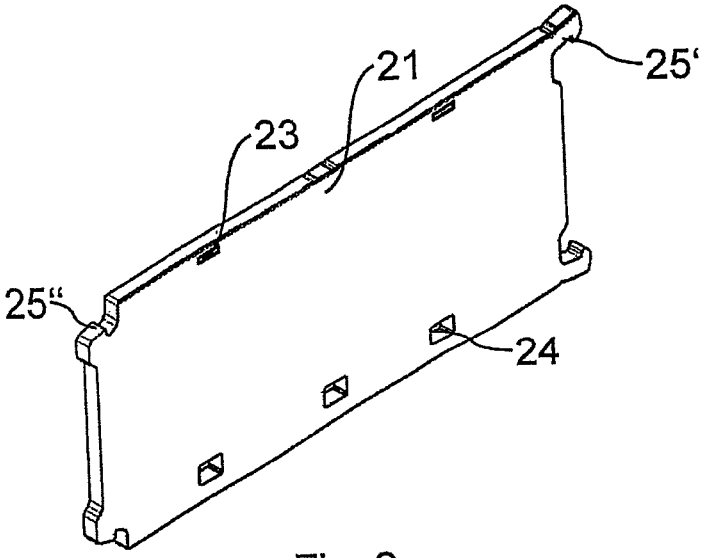
FIG. 2 shows a sleeve blank.

In FIG. 2, a sleeve blank 21 is shown. In the punching device 1, the counter-latching elements 24 are punched out and protrusions are formed on the opposite side of the first metal strip 22 by the punching-in of recesses. The protrusions serve as retaining elements 23. Formed on those edge portions of the first metal strip 22 which are opposite in the longitudinal direction are mutually corresponding connection portions 25', 25", which are in the form of latching and counter-latching elements and are latched to one another in the separating and forming device 2. Before the separating, the plurality of sleeve blanks 21 are connected to one another by the perforation 27, wherein, in the case of the sleeve blank 21 shown, the perforation is in each case in the form of a web on a connection portion 25' in the form of a latching element, running from the connection portion 25' in the longitudinal direction to the connection portion 25", in the form of a counter-latching element, of a directly adjacent sleeve blank.

Figure 3:
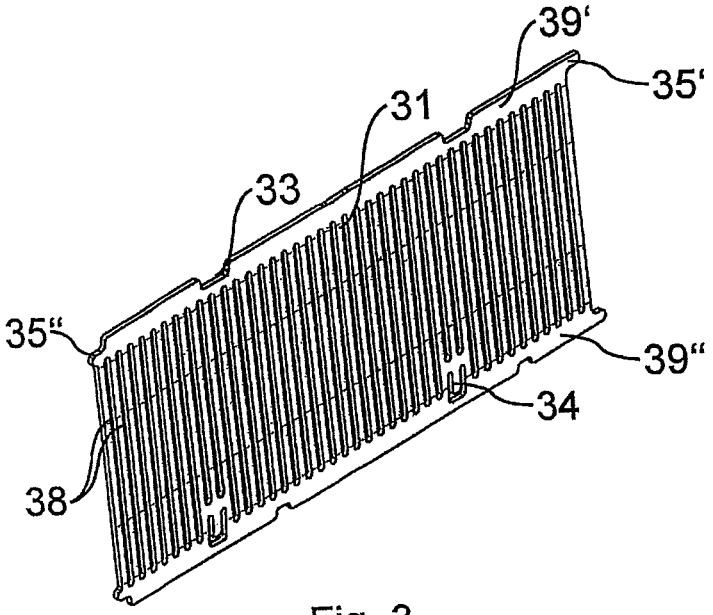
FIG. 3 shows a contact cage blank.

A contact cage blank 31 is shown in FIG. 3. A grating structure having contact lamellae is formed on the contact cage blank 31 by a plurality of cutouts 38 that run parallel to one another. Here, the cutouts 38 run from a in the width direction of the second metal strip 32, from which the contact cage blank 31 is formed, from a first to a second edge region 39', 39". The webs formed by the cutouts 38, each web being between two cutouts 38, connect the first edge region 39' to the second edge region 39". During the die-stamping, the latching elements 33, 34 are formed in the first and the second edge regions 39', 39". The latching elements 34 which are in the second edge region 39" are in the form of latching lugs here, which are bent out from the plane of the metal strip in order to be able to engage resiliently into the counter-latching elements 24 of the sleeve. At the edge regions in the longitudinal direction of the second metal strip 32 there are mutually corresponding connection portions 35', 35", which are formed during the die-stamping. During the rolling of the contact cage blank 31 to give the contact cage 30 in the separating and forming device 2, the edge regions in the longitudinal direction are aligned with one another by means of the connection portions 35', 35", by virtue of in each case a connection portion 35' in the form of a tongue being brought to rest on the connection portion 35" in the form of a supporting surface. The perforation 37 connects multiple contact cage blanks 31 to one another, such that they are lined up with one another in strip form. Here, the perforation 37 is formed in each case by a web on a connection portion 35', which extends in the longitudinal direction of the second metal strip 32 from the respective connection portion 35' to the directly adjacent connection portion 35" of the directly adjacent contact cage blank.

Figure 4:
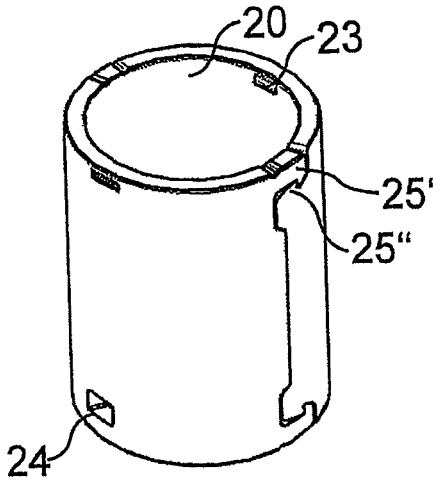
FIG. 4 shows a sleeve.
Figure 5:
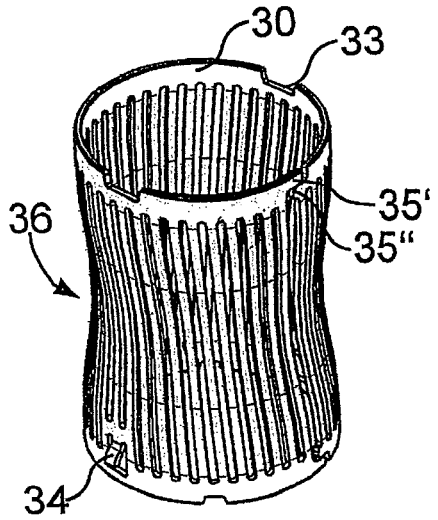
FIG. 5 shows a contact cage.

FIGS. 4 and 5 show the sleeve 20 and the contact cage 30 after the separating and forming by the separating and forming device 2. The respective connection portions 25', 35' are brought into engagement or to bear against the respectively corresponding connection portions 25", 35". The latching element 34 in the form of a tongue is bent outward, such that during the assembly it can engage or latch into the counter-latching element 24 in the form of an opening. In the encircling region 36 of the contact cage 30, which is arranged centrally in the width direction of the second metal strip 32, from which the contact cage 30 is formed, an inwardly pointing bulge or constriction is formed by torsion.

Figure 6:
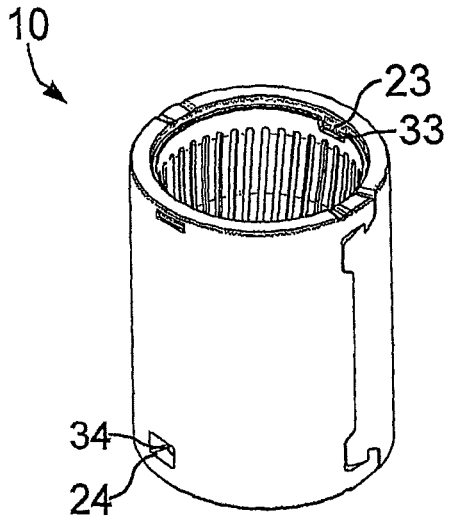
FIG. 6 shows a socket contact.

In FIG. 6, the socket contact 10 is shown after the assembly, wherein the latching element 33, which is in the form of a groove-shaped recess, bears against the retaining element in the form of a supporting surface and the latching element 34 in the form of a tongue engages into the counter-latching element 24 in the form of an opening. Here, the assembly takes place by laterally pushing the contact cage 30 into the sleeve 20 transversely to the transport direction of the strips 22, 32. The connection portions 35', 35" of the contact cage serve merely for aligning the respective edge regions with respect to one another, whereas the connection portions 25', 25" of the sleeve 20 serve for holding together the tubular or hollow-cylindrical socket contact 10.

Figure 7:
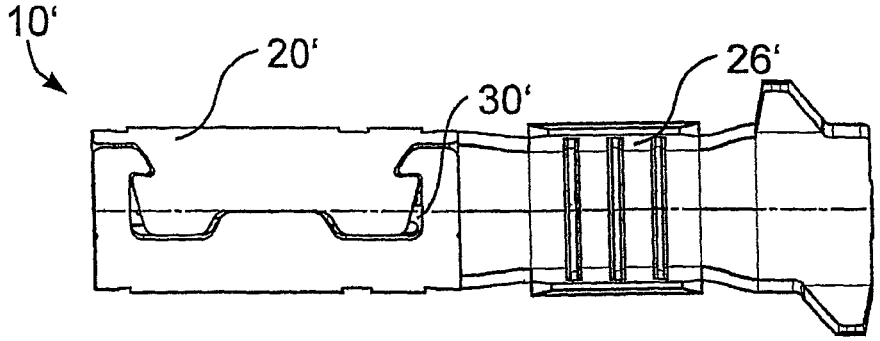
FIG. 7 shows an alternative embodiment of a socket contact.

FIG. 7 shows a further embodiment of the socket contact as a socket contact 10'. Here, the sleeve 20' of the socket contact 10' is lengthened in the width direction, wherein a connection portion 26' is formed during the die-stamping, separating and forming. A conductor can be connected directly to the socket contact 10' through the connection portion 26'.

The invention is not restricted in terms of its embodiment to the preferred exemplary embodiments specified above. Rather, numerous variants are conceivable, which make use of the solution illustrated even in the case of fundamentally different embodiments. For example, the sleeve and the contact cage could be brought into a polygonal tubular shape during the forming by being bent along predetermined bending edges.

LIST OF REFERENCE DESIGNATIONS

1 Punching device
2 Separating and forming device
3 Assembly device
10 Socket contact
10' Socket contact
20 Sleeve
20' Sleeve
21 Sleeve blank
22 First metal strip
23 Retaining element
24 Counter-latching element
25' Connection portion
25" Connection portion
26' Connection portion
27 Perforation
30 Contact cage
30' Contact cage
31 Contact cage blank
32 Second metal strip
33 Latching element
34 Latching element
35' Connection portion
35" Connection portion
36 Encircling region
37 Perforation
38 Cutout
39' First edge region
39" Second edge region
L1 Longitudinal direction
L2 Longitudinal direction

The invention claimed is:

1. A method for producing a socket contact comprising a sleeve and a contact cage, which are formed from a first and a second metal strip, wherein at least one step for forming the sleeve and one step for forming the contact cage are performed in a parallel shaping and forming process, the method comprising the steps of:

feeding the first metal strip into a first punching device and feeding the second metal strip into a second punching device;

perforating and die-stamping the first metal strip by a punching tool of the first punching device, wherein a perforation is carried out in each case after a first predetermined length and the first metal strip is formed by the die-stamping to give a sleeve blank having connection portions, wherein the sleeve blank is connected by the perforation to a subsequent sleeve blank, such that the first metal strip is formed to give a plurality of sleeve blanks connected at the perforation;

perforating and die-stamping the second metal strip by a punching tool of the second punching device, wherein a perforation is carried out in each case after a second predetermined length and the second metal strip is formed by the die-stamping to give a contact cage blank having a grating structure and connection portions, wherein the contact cage blank is connected by the perforation to a subsequent contact cage blank, such that the second metal strip is formed to give a plurality of contact cage blanks connected at the perforation; and feeding the first metal strip, comprising the plurality of sleeve blanks, to a first separating and forming device and feeding the second metal strip comprising the plurality of contact cage blanks, to a second separating and forming device, separating and forming the first metal strip comprising the plurality of sleeve blanks, in the first separating and forming device, wherein in each case the sleeve blank is separated from the first metal strip at the perforation and formed by rolling or bending the sleeve blank to give the sleeve and, separating and forming the second metal strip comprising the plurality of contact cage blanks, in the second separating and forming device, wherein in each case the contact cage blank is separated from the second metal strip at the perforation and formed by rolling or bending the contact cage blank to give the contact cage.

2. The method as claimed in claim 1, wherein the method further comprises at least the following steps:

a. feeding the sleeve and the contact cage to an automatic assembly device, b. assembling the sleeve and the contact cage in the assembly device to give the socket contact, wherein the contact cage is pushed into the sleeve transversely to the transport direction of the strips and fixed to the sleeve.

3. The method as claimed in claim 2, further comprises the step of controlling the first and the second punching device and the first and the second separating and forming device such that the respective method steps are performed in parallel.

4. The method as claimed in claim 2, wherein, during the assembly, latching elements are latched to a respective counter-latching element or bear against a retaining element in order to fix the contact cage in the sleeve.

5. The method as claimed in claim 1, wherein the first and the second punching device are formed integrally with one another.

6. The method as claimed in claim 1, wherein the first and the second punching tool are formed in one piece with one another.

7. The method as claimed in claim 1, wherein a grating structure of the second metal strip is formed by punching out cutouts running parallel to one another and running orthogonally with respect to the longitudinal direction of the second metal strip or at an angle to the longitudinal direction of the second metal strip.

8. The method as claimed in claim 1, wherein, before the separating and forming of the second metal strip, the method comprises an additional step of forming the second metal strip in which the second metal strip is compressed in its width, such that a central region running along the second metal strip protrudes convexly out from the second metal strip.

9. The method as claimed in claim 1, wherein, during the die-stamping of the first and the second metal strip, a connection portion is formed in each case on two edge portions which are opposite in the longitudinal direction of the respective metal strip, which connection portions engage into one another during the forming of the respective metal strip.

10. The method as claimed in claim 1, wherein, during the die-stamping of the first and the second metal strip, mutually corresponding latching, counter-latching and retaining elements are punched into the first and second metal strips.

11. The method as claimed in claim 1, wherein, during the forming of the contact cage blank to give the contact cage, the contact cage is twisted such that a region that is central in a width direction and runs in an encircling manner in a circumferential direction is constricted.

* * * * *